US010926315B2

(12) United States Patent
Anagnostopoulos

(10) Patent No.: US 10,926,315 B2
(45) Date of Patent: Feb. 23, 2021

(54) SYSTEMS AND PROCESSES FOR FEEDING LONGITUDINAL WIRES OR RODS TO MESH PRODUCING MACHINES

(71) Applicant: Antonios Anagnostopoulos, Kiffisia Attikis (GR)

(72) Inventor: Antonios Anagnostopoulos, Kiffisia Attikis (GR)

( * ) Notice: Subject to any disclaimer, the term of this patent is extended or adjusted under 35 U.S.C. 154(b) by 605 days.

(21) Appl. No.: 15/111,181

(22) PCT Filed: Mar. 31, 2015

(86) PCT No.: PCT/IB2015/052369
§ 371 (c)(1),
(2) Date: Sep. 30, 2016

(87) PCT Pub. No.: WO2015/151029
PCT Pub. Date: Oct. 8, 2015

(65) Prior Publication Data

US 2017/0008065 A1 Jan. 12, 2017

(30) Foreign Application Priority Data

Apr. 1, 2014 (GR) ..... 20140100176

(51) Int. Cl.
*B21F 23/00* (2006.01)
*B21F 27/10* (2006.01)

(52) U.S. Cl.
CPC ..... *B21F 23/005* (2013.01); *B21F 23/002* (2013.01); *B21F 27/10* (2013.01)

(58) Field of Classification Search
CPC ..... B21F 27/10; B21F 23/002; B21F 23/005; B21F 27/08; B21F 15/06; B21F 15/08; B23K 11/008
See application file for complete search history.

(56) References Cited

U.S. PATENT DOCUMENTS 1,438,322 A 12/1922 Meltz
1,915,184 A 6/1933 Cosgrove
(Continued)

FOREIGN PATENT DOCUMENTS

AT 214241 B 3/1961
AT 384968 B 2/1988
(Continued)

OTHER PUBLICATIONS

EP 15 721 321 6—European Search Report dated May 2, 2017, 6 pages—English.
(Continued)

*Primary Examiner* — Debra M Sullivan
(74) *Attorney, Agent, or Firm* — Andrew F. Young, Esq.; Nolte Lackenbach Siegel

(57) ABSTRACT

Systems and processes for feeding longitudinal wires in a mesh 3 production machine. Mesh 3 is produced by the welding of longitudinal wires 2 with transverse wires 6 at a welding unit 27. The longitudinal wires may be pulled from decoiler reel 40, straightened, and then deposited in longitudinals storage 19. They are then received by a longitudinals carrier 15 and transported towards welding unit 27. The longitudinal wires 2 are selectively rotated around their longitudinal axes with selected angle, and restrained until their welding with the transverse wires. This negates effects of any possible curvature acquired during their straightening with rollers 9, so that after their welding, the resulting mesh 3 is produced planar with the distortion stresses neutralized.

18 Claims, 9 Drawing Sheets

(56) References Cited

U.S. PATENT DOCUMENTS

| | | | | |
|---|---|---|---|---|
| 1,923,369 | A | 8/1933 | Gronemeyer et al. | |
| 1,961,991 | A | 6/1934 | Southwell | |
| 2,040,349 | A | 5/1936 | Wagner | |
| 2,390,174 | A | 12/1945 | Roemer | |
| 2,401,319 | A | 6/1946 | Roemer | |
| 2,448,941 | A | 9/1948 | Wickwire | |
| 3,286,072 | A | 11/1966 | Ritter et al. | |
| 3,369,575 | A | 2/1968 | Rosler | |
| 3,405,743 | A | 10/1968 | Robinson | |
| 3,515,177 | A | 6/1970 | Gott et al. | |
| 3,597,568 | A | 8/1971 | Rach | |
| 3,602,269 | A | 8/1971 | Gott et al. | |
| 4,249,841 | A | 2/1981 | Gott et al. | |
| 4,539,457 | A | 9/1985 | Pinger et al. | |
| 4,656,860 | A | 4/1987 | Orthuber et al. | |
| 4,735,075 | A | 4/1988 | Saegusa | |
| 4,848,560 | A | 7/1989 | Scherr et al. | |
| 5,005,689 | A | 4/1991 | Maier et al. | |
| 5,020,575 | A | 6/1991 | Grabuschnig et al. | |
| 5,125,436 | A | 6/1992 | Grabuschnig et al. | |
| 5,170,654 | A | 12/1992 | Anagnostopoulos | |
| 5,271,436 | A | 12/1993 | Pfender et al. | |
| 5,446,254 | A | 8/1995 | Ritter et al. | |
| 5,647,110 | A | 7/1997 | Ritter et al. | |
| 5,688,412 | A * | 11/1997 | Thalenfeld | A47B 55/02 140/112 |
| 6,045,031 | A | 4/2000 | Ritter et al. | |
| 6,054,031 | A | 4/2000 | Benton | |
| 6,241,142 | B1 | 6/2001 | Chou et al. | |
| 7,100,642 | B2 | 9/2006 | Taboga | |
| 7,247,809 | B2 | 7/2007 | Ritter | |
| 7,497,105 | B2 | 3/2009 | Anagnostopoulos | |
| 7,878,038 | B2 | 2/2011 | Anagnostopoulos | |
| 2007/0007252 | A1 | 1/2007 | Ritter | |
| 2008/0009945 | A1 | 5/2008 | Vittone | |
| 2012/0103460 | A1 | 5/2012 | Anagnostopoulos | |

FOREIGN PATENT DOCUMENTS

| | | | |
|---|---|---|---|
| AT | 397357 | B | 3/1994 |
| CN | 101961763 | A | 2/2011 |
| DE | 2142321 | A1 | 3/1973 |
| DE | 2319003 | A1 | 10/1974 |
| DE | 4423737 | A1 | 1/1995 |
| DE | 10048104 | A1 | 10/2001 |
| EP | 0122883 | A2 | 10/1984 |
| EP | 0263607 | A1 | 4/1988 |
| EP | 0371956 | A2 | 6/1990 |
| EP | 0452246 | A2 | 10/1991 |
| EP | 0459934 | A2 | 12/1991 |
| EP | 0733416 | A1 | 9/1996 |
| EP | 0780174 | A1 | 6/1997 |
| EP | 1110656 | A1 | 6/2001 |
| EP | 1908537 | A1 | 4/2008 |
| EP | 2149410 | A1 | 2/2010 |
| EP | 2433724 | A1 | 3/2012 |
| GB | 1314754 | A | 4/1973 |
| GR | 20050100010 | B | 2/2006 |
| JP | H09-001270 | A | 1/1997 |
| JP | H10-249471 | A | 9/1998 |
| WO | 93/019868 | A1 | 10/1993 |
| WO | 99/041029 | A1 | 8/1999 |
| WO | 00/51760 | A1 | 9/2000 |
| WO | 03/072279 | A1 | 9/2003 |
| WO | 03/103874 | A1 | 12/2003 |
| WO | 03/106070 | A2 | 12/2003 |
| WO | 2007/110400 | A1 | 10/2007 |
| WO | 2011/010256 | A1 | 1/2011 |
| WO | 2011/048501 | A2 | 4/2011 |
| WO | 2011/114175 | A1 | 9/2011 |
| WO | 2011/158070 | A1 | 12/2011 |

OTHER PUBLICATIONS

EP 15 721 321 6—Response to Search Rerpot dated Aug. 1, 2017, 2 pages—English.

EP 15 721 321 6—Amended Claims, pp. 21-25, 5.

EP 15 721 321 6—Amended Claims with annotations, pp. 21-25.

PCT Search Report and PCT written report on patentability dated Jul. 15, 2015 from parent PCT application No. PCT/IB2015/052369, in English.

Search report of the Greek (GR) National Patent Office in priority application GR20140100176, report dated May 21, 2015; discussed in Applicant's transmittal letter.

* cited by examiner

SYSTEMS AND PROCESSES FOR FEEDING LONGITUDINAL WIRES OR RODS TO MESH PRODUCING MACHINES

This application is a 35 U.S.C. 371 national-phase entry of PCT International application no. PCT/IB2015/052369 filed on Mar. 31, 2015 and also claims benefit of priority to prior Greek national application no. GR-20140100176 filed on Apr. 1, 2014, and Greek national application no. GR-20140100176 and parent PCT International application no. PCT/IB2015/052369 are incorporated herein by reference in their entireties and as to all their parts for all intents and purposes, as if identically set forth in full herein.

TECHNICAL FIELD

The present disclosure relates to systems and processes for feeding wires and rods for mesh production. The wires or rods are typically produced by pulling the wire or rod material from spools, straightening the material with rollers, and advancing the material with rollers. After their production, they are transferred to a welding unit while being restrained by grippers. Employing a straightener with rollers may permit high speeds, but on the other hand achieves relatively poor straightening. Because of the nonuniformities of the material diameter, as well as the internal stresses that are generated during the wire or rod production, this straightening results in bow-effect (deflection) of the produced wires and rods, whereby the wires and rods having passed through straightening typically exhibit a curvature in one plane. According to the present disclosure, the longitudinal wires and rods may be selectively rotated around their respective longitudinal axes, so that their respective bow-effects resulting from the straightener are also respectively rotated. The respective curvatures of the longitudinal members thus take specified directions, so that they effectively negate one another in the totality of the wires or rods when welded as a mesh. The result is a relatively planar mesh, yet produced with relatively rapid feeding of longitudinal wires.

BACKGROUND ART

Meshes have typically been produced from longitudinal wires and transverse wires welded at specified distances relative to each other. In productive mesh welding machines, the longitudinal wire and the transverse wires typically come from wires wound in coils. Each longitudinal wire comes from a corresponding spool. The longitudinal wires are pulled from respective reels, and all of them pass through straighteners that are each individually adjustable. The longitudinal wires also pass through feeding mechanisms and intermediate storages. Transverse wire typically also comes from a spool, and is fed by feeding rollers through straightener with rollers. Machines of this type may have high productivity, but exhibit small flexibility as to changing the product, such as changing of the spool and the wire diameter. Changing of the wire diameters creates large delays. Furthermore, such machines need a large area because of the large number of reels and spools for the longitudinal wires that are handled. Prior U.S. Pat. No. 7,100,642B2 provides an example. Previous published application WO2011/010256A1, particularly at FIG. 6 thereof, provides an exemplary teaching of prior art practices in this regard.

In another category of machines, the longitudinal wires are produced by other straightening machines and are transported to the mesh welding machine. These longitudinal wires are straightened and precut to the suitable dimensions.

Their placement in the welding machine is made manually. Previous published application WO2011/010256A1, particularly at FIGS. 7A-7B thereof, provided an exemplary teaching of prior art practices in this regard. Such machines are characterized by their small size, higher flexibility to production changes, and relatively low productivity. Automated feeding of the longitudinal wires may be made, from a storage where these longitudinals are stored, by mechanisms with pincers. This storage is vibrated by vibrators, and pincers with carrier and sensors receive the wires and transport them to a second carrier that then transports them towards the welding heads. Prior DE-4423737 A1 is indicative in this regard. This type of machine is complex, presents malfunctions, and is not flexible in the procedure of changing diameters or lengths of the longitudinals, because such changing presumes first an emptying of the storage, and then a filling of it with the new wires.

In yet another category of welding machines, the longitudinal wires come from a spool on a reel. They are straightened and cut at the suitable lengths for the mesh. Subsequently, they are automatically transported towards the mesh welding machine. Because the longitudinal wires have a large length, for example mesh of width 2 m and length 6-12 m being common, straightening of the longitudinal wires is made with rotors and not with two-plane roller straighteners, so that the wires are relatively perfectly straightened. Then, during the transport of these wires from their production location towards the welding heads, these wires are rolled, transported or driven by gravity with chains and sheaths. The straightener with rotor produces relatively perfect straightening quality, but the straightened wire proceeds at low speed. Consequently, while these machines are flexible in regards to changing wire diameter and length, nevertheless, they achieve very low productivity primarily because of the low speed of the rotor straightening.

SUMMARY

Technical Problem

In this context, employment of two-plane roller straighteners to achieve higher production speed of the longitudinal wires resulted in the problem of relatively poor straightening quality. Thus, the resulting curvatures of wires that are transported, by transport or rolling, to the welding heads, both complicate the transport and also deform the welding-produced mesh, as distortion stresses are not neutralized over the totality of wires.

Solution to the Problem

Thus, it may be understood as also within the scope of the present disclosure to set forth: systems for feeding wire to a mesh production machine comprising a roller straightener for wire; a cutter configured to receive wire straightened by this roller straightener; a longitudinals storage configured to receive longitudinal wires cut by this cutter, the longitudinals storage having a number of longitudinals positions; the system including a rotational unit configured to rotate longitudinal wires around their longitudinal axes to specified angles, this rotational unit being located at an intermediate location in the path of the longitudinal wires from their production location to their welding location; respective grippers, that may be actively-restraining or passively-restraining type, configured to restrain longitudinals wires in the longitudinals storage; a longitudinals carrier configured to transfer longitudinal wires from the longitudinals storage towards a welding unit, this longitudinals carrier having grippers, that may be actively-restraining or passively-restraining type, configured to restrain the longitudinal wires at least until their welding with a first transverse wire which may be supplied via either: (a) a reel via advancement mechanism, straightening mechanism and cutting mechanism, or, (b) as straightened and precut transverse wire fed by a feeder.

Furthermore, it may be understood as within the scope of the present disclosure to also set forth processes for feeding longitudinal wires to a mesh production machine comprising the steps of: pulling wire from a spool; straightening the pulled wire with rollers; cutting the straightened pulled wire to produce longitudinal wires; depositing the longitudinal wires at a longitudinals storage; transferring the longitudinal wires from the longitudinals storage to a longitudinals carrier; moving the longitudinal wires towards a welding unit; and, welding the wires into mesh with transverse wire; this process including the steps of, selectively rotating respective longitudinal wires around their respective longitudinal axes to specified angles; and, restraining the longitudinal wires until their welding in the mesh.

According to the scope of the present disclosure, solutions are set forth in the way of systems and processes.

Advantageous configurations and further developments are evident from the entirety of the present description, including the appended figures of the drawings.

In additional aspects, solutions may be facilitated by exemplary, non-limiting subassemblies including particular versions of rotational units and/or cutters that may be understood to also be deserving of protection as inventions independently. Thus, for example, a solution within the scope of the present disclosure may be facilitated by a subassembly including inventive exemplary rotational unit having a gripper, this gripper having restraining tools, this rotational unit being one in which the restraining tools have an opening on the side to permit wire removal in a direction of a plane of wires at a longitudinals storage; having a cylinder for activating the restraining tools to hold wire; having a bearing and plate upon which the gripper is seated, this bearing having an opening in its side in the direction of the plane of longitudinal wires at the longitudinals storage; and, this gripper being rotatable around an axis of the held wire to also rotate the held wire to desired angle.

At this point, it is pointed out that, in the context of this disclosure, the term "wire" should equivalently be understood as meaning or indicating, in the context of the present disclosure, claims and appended drawings, either a wire or rod, or other suitable elongate material employed in mesh production; as in implementations of the invention the material employed, as well as the dimensions of the individual elements, may be commensurate with the requirements of particular applications.

Advantageous Effects

Systems and processes according to the present disclosure may be understood to present many advantages, especially notably in attaining relatively high productivity by employing rollers for the straightening and advancement of the longitudinal wires. Systems and processes according to the present disclosure exhibit exceptional flexibility as to changing the diameter of the longitudinal wire. Systems and processes within the present disclosure may produce meshes of different dimensions, one after the other, without significant effect to system productivity. Systems and processes within the present disclosure can select the diameter of the longitudinal wires from different reels, provided there are corresponding feeding lines for longitudinals, one for each wire. Furthermore, systems and processes according to the present disclosure may be fully automated and controlled via computer.

Processes within the present disclosure produce the longitudinal wires of meshes with high speed and produce mesh without deformation. They simultaneously maintain the flexibility and the relatively small spatial extent of the machine system. Systems within the present disclosure produce the longitudinal wires with relatively high speed, transport them to welding units, and place the longitudinal wires with individually specified directions and curvatures, so that there is net negation over the totality of wires to effectively neutralize mesh distortion stresses, and so that effectively planar mesh is produced.

BRIEF DESCRIPTION OF THE DRAWINGS

Aspects of the systems and processes according to the present disclosure may be understood from the following description and from the appended drawings, where exemplary versions of the processes and systems are presented, and where parts that are the same or similar in the several drawings are provided with the same reference numeral labels.

DESCRIPTION

Figure 1:
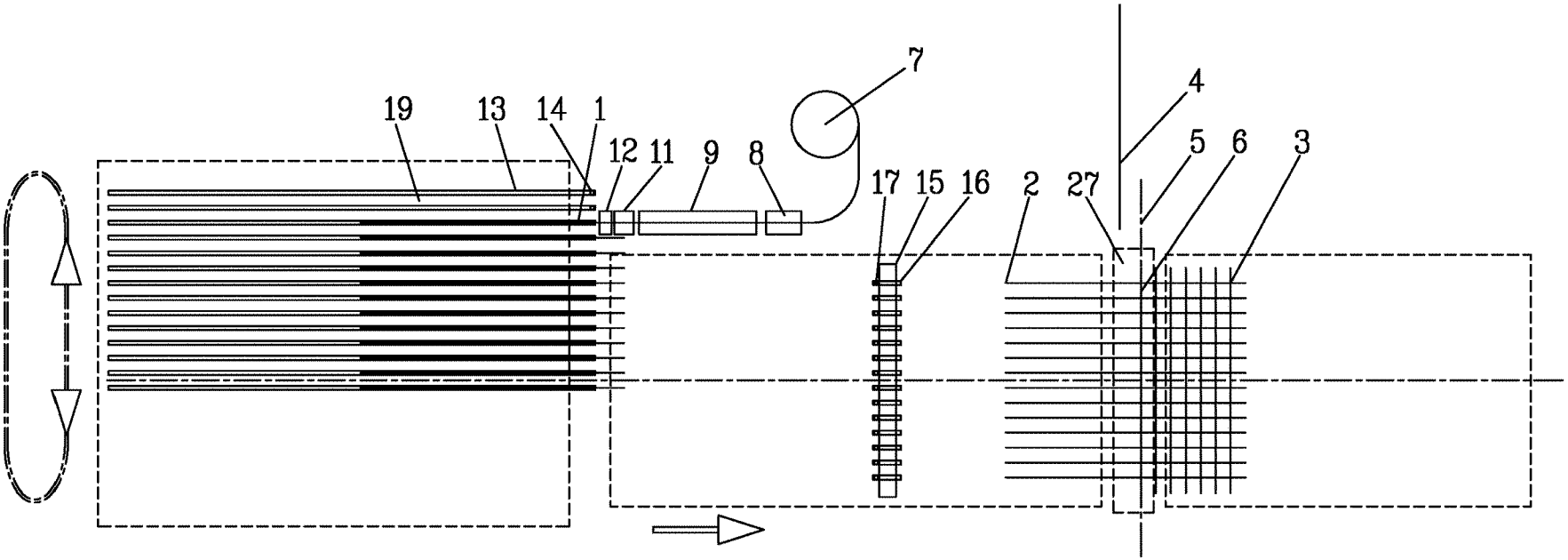
FIG. 1—schematically depicts operational principles of exemplary processes and systems.
Figure 2:
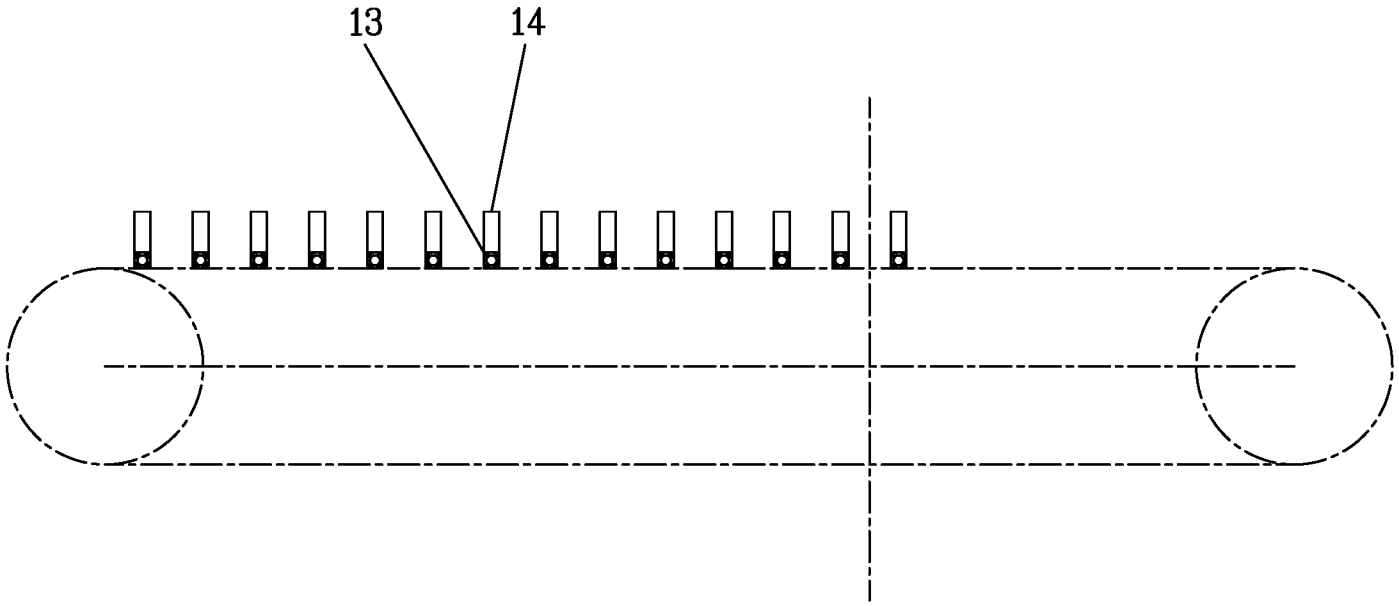
FIG. 2—depicts details of operational principles of exemplary processes and systems.
Figure 3A:
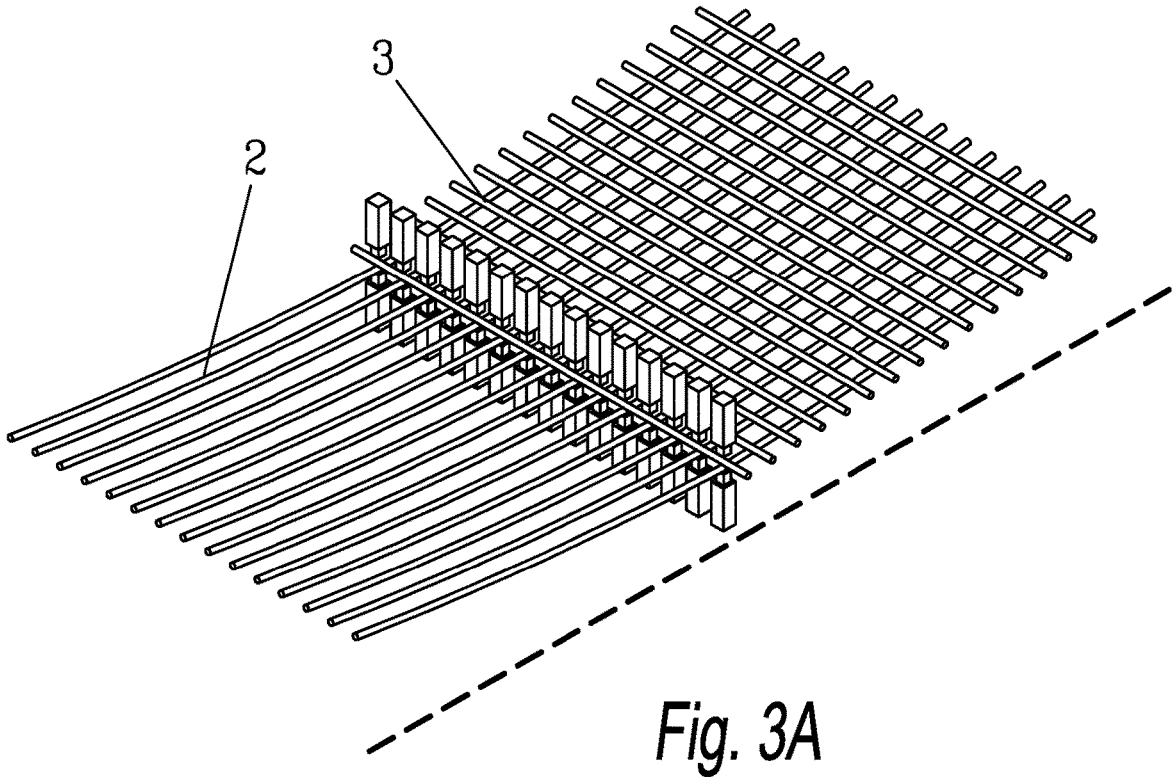
FIG. 3A—depicts the effect of the curvature of the longitudinals upon the planarity of welded mesh.
Figure 4A:
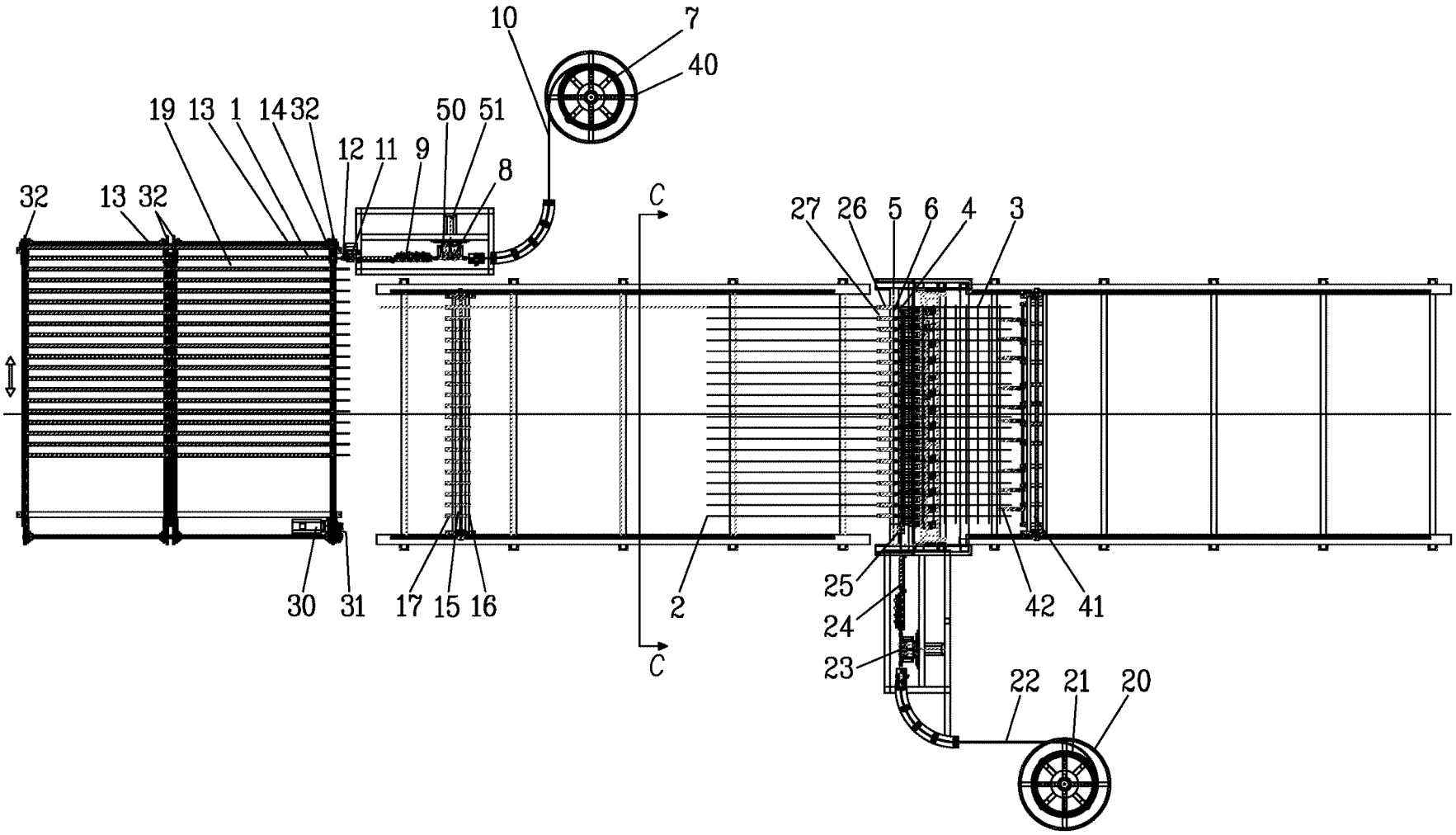
FIG. 4A—depicts an exemplary welding machine in top view.
Figure 4B:
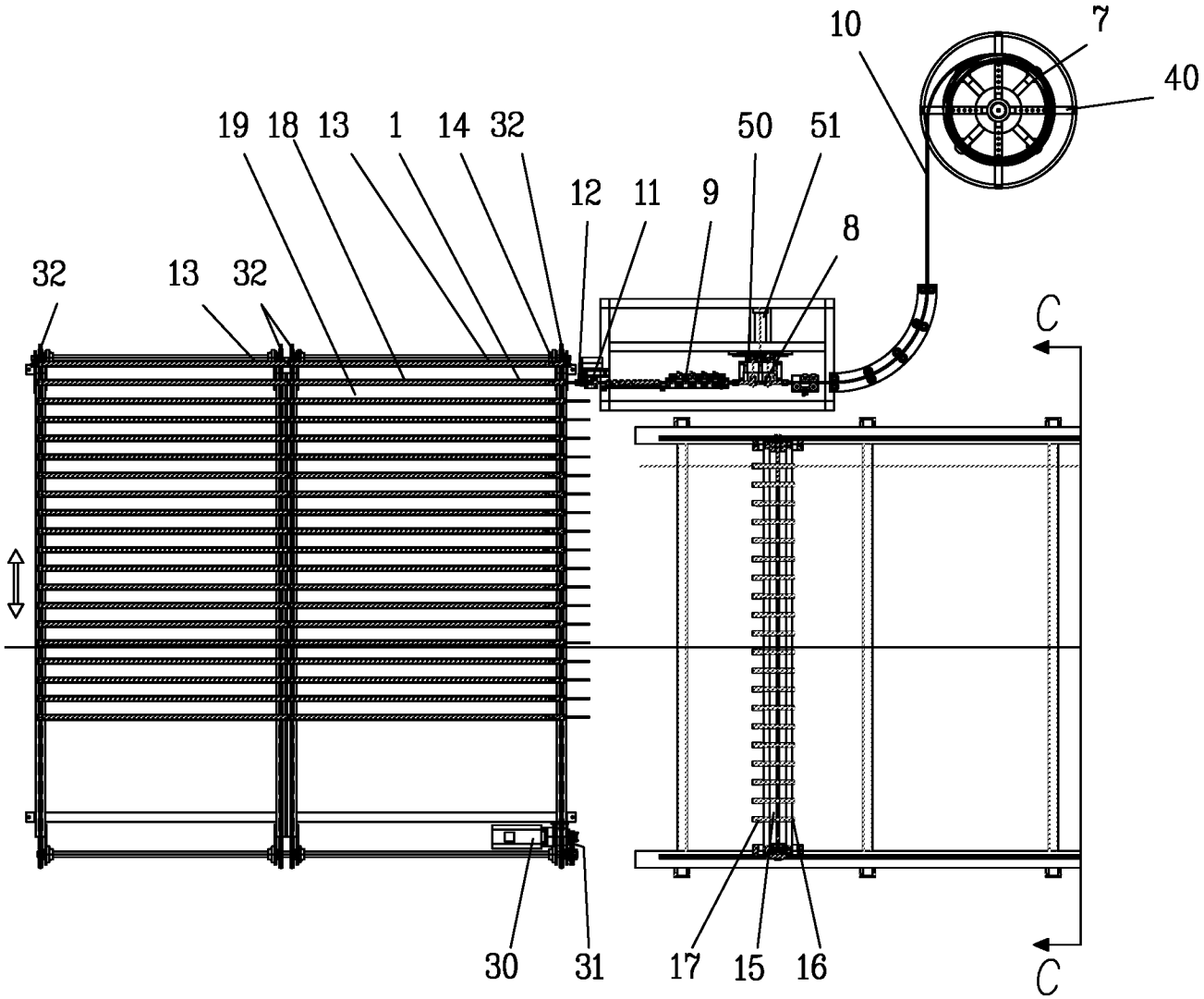
FIG. 4B—magnified view of the left side of FIG. 4A relative to section C-C.
Figure 4C:
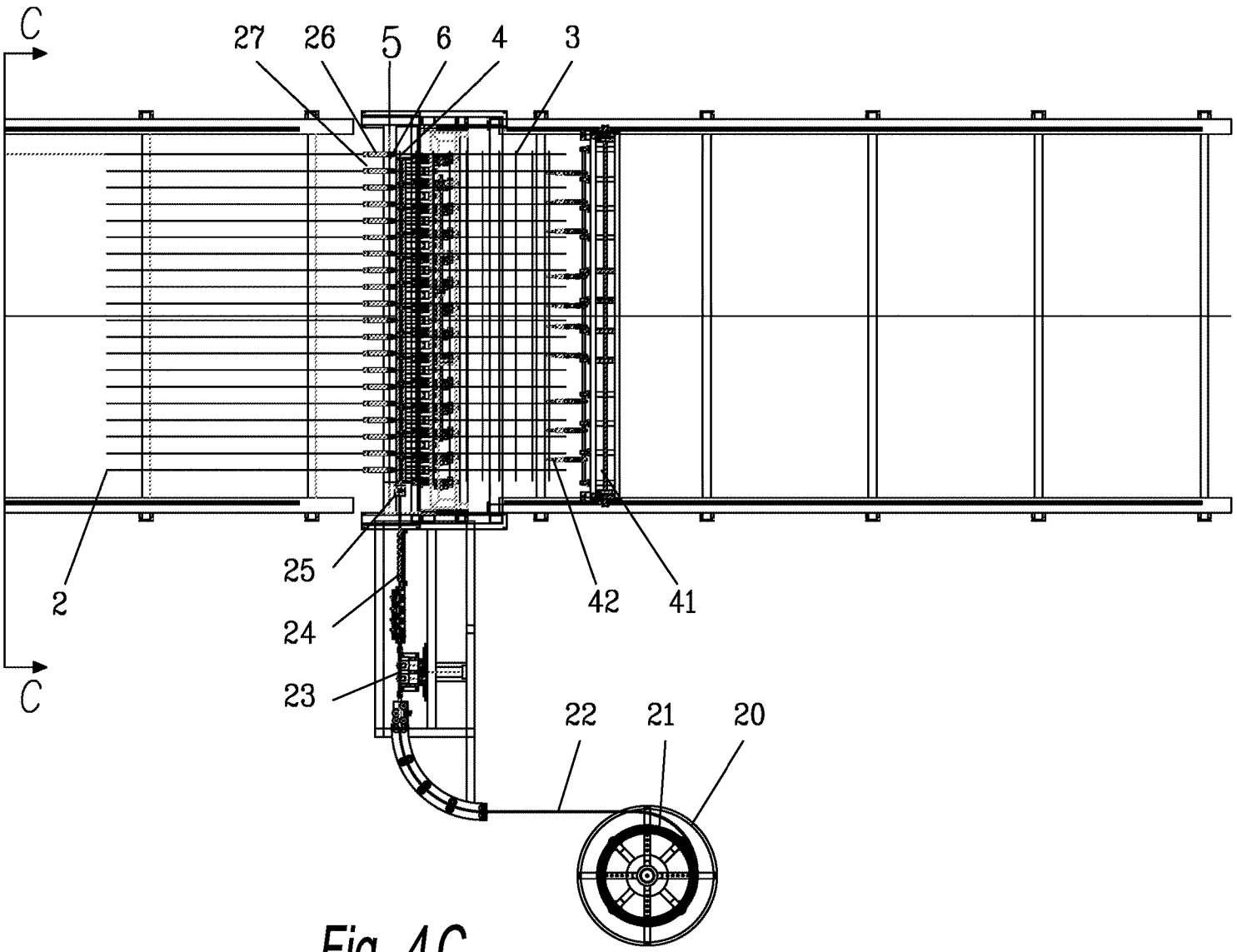
FIG. 4C—magnified view of the right side of FIG. 4A relative to section C-C.
Figure 5:
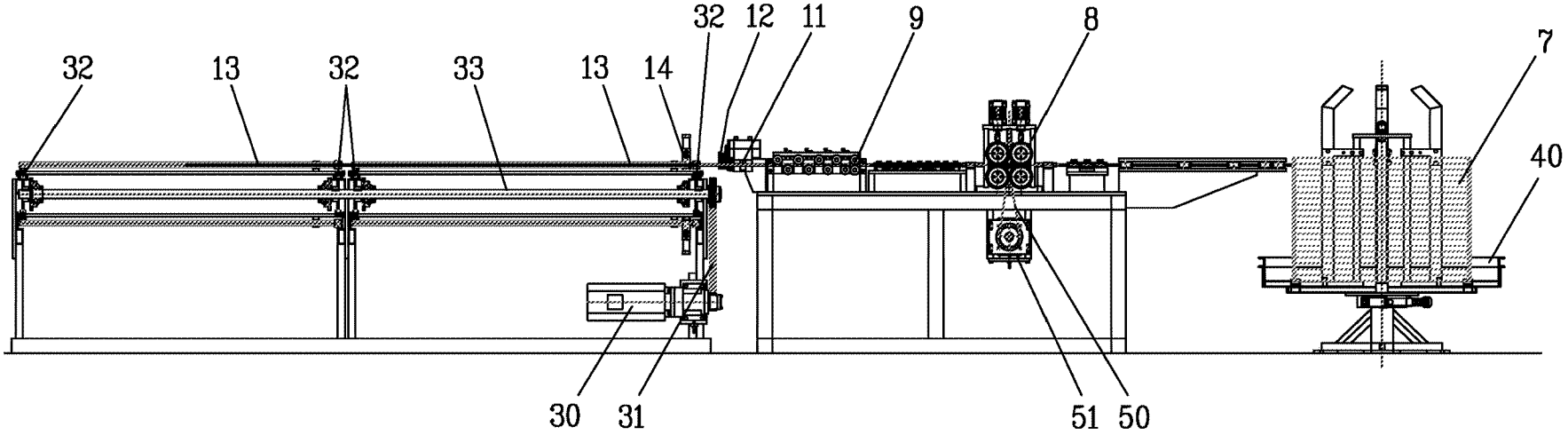
FIG. 5—isolation view of an exemplary longitudinals storage 19 and its supply.

Exemplary versions of systems and processes may be understood with particular reference to FIGS. 1-3, as well as the remaining FIGS. 4-6.

As schematically indicated in FIG. 1, according to exemplary versions of systems and processes within the scope of the present disclosure, a product mesh 3 is produced from transverse wires 6 that are welded on the longitudinal wires 2, in the welding unit 27.

In versions depicted in FIGS. 1,4-5, longitudinal wires 2 are pulled from at least one spool 7 on a reel, and are advanced by pulling mechanisms such as advancement rollers 8. Thus, the longitudinal wires 2 are produced from spool 7 that is situated on decoiler reel 40. Wire 10 for longitudinals is pulled by the unit having feeding rollers 8. This wire 10 passes through dual plane straightener 9 with rollers, then through the cutter 11 and the rotational unit 12 towards the longitudinals storage 19. Thus, the longitudinal wires 9 are straightened in a straightener with rollers 9. Subsequently, they are guided through the cutter 11 and a rotational unit 12 towards the positions 13, which as depicted are receivers, of the longitudinals storage 19.

As depicted in FIGS. 1-2, 4, the exemplary longitudinals storage 19 includes longitudinals positions 13 in a number at least equal to the greatest number of longitudinal wires in a mesh. Each longitudinals position 13 of the longitudinals storage 19 includes a sheath in tube form 18 that may be unitary or sectional, and at the beginning of which there is a gripper 14. The longitudinals storage 19 includes respective sheaths in tube form 18, unitary or sectional, at the beginning of each of which there is one respective gripper 14 that may be of type activated by a cylinder. These grippers 14 along with the sheaths 18 are located on chains 32 that have step equal to the least distance of the longitudinals 2 of the produced mesh 3, and which rotate on sprocket wheels and are driven by motor 30 and transmissions 31. Thus, the tubes 18 are located on chains 32 at relative distances equal to the least distance of the longitudinals of the mesh. The chain 32 is seated on sprocket wheels that rotate so that any position 13 of the longitudinals storage 19 may be transported to the feeding axis 1 of longitudinal wires 2.

Cutters 11 are generally indicated in FIGS. 1,4-5. As depicted in detail in FIG. 6B, a specific exemplary version of wire cutter 11 has a fixed cutting tool 81 towards the side of the gripper 12 and a movable cutting tool 80 that has a hole through which passes the wire that is carried along with the movable cutting tool 80 during cutting.

Immediately after the cutter 11 is located a rotational unit 12 that rotates the wire at a programmed angle. This rotational unit 12 is activated and grips the wire before cutting 11, and then rotates it a particular angle. In following, the gripper 14 on the longitudinals storage 19 is activated to restrain the wire 2, and finally the rotational unit 12 releases the wire 2.

Figure 6A:
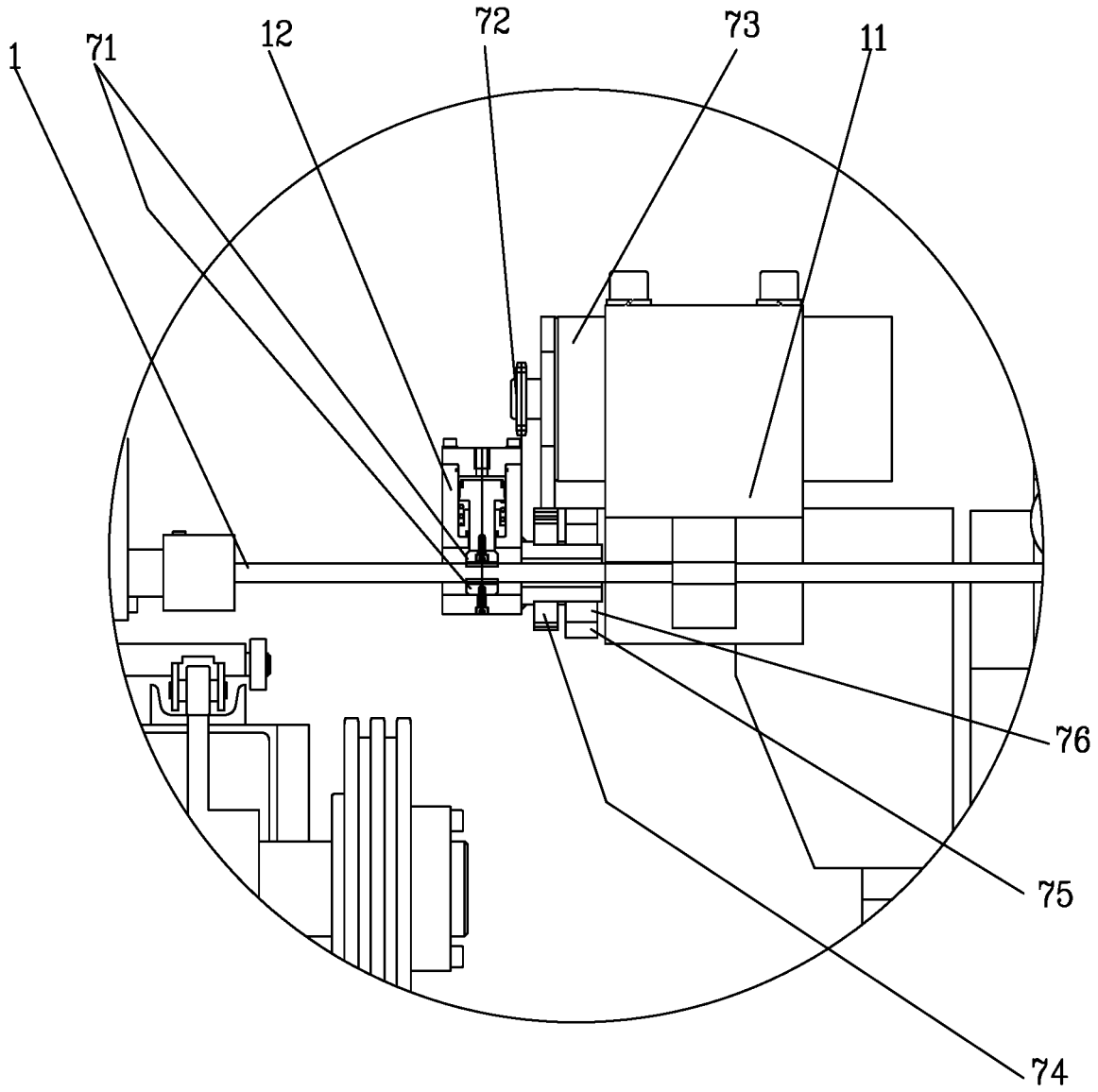
FIG. 6A—a first view depicting details of a rotational unit 12 with gripper; and, FIG. 6B—a second view depicting rotational unit 12 and details of cutter 11.
Figure 6B:
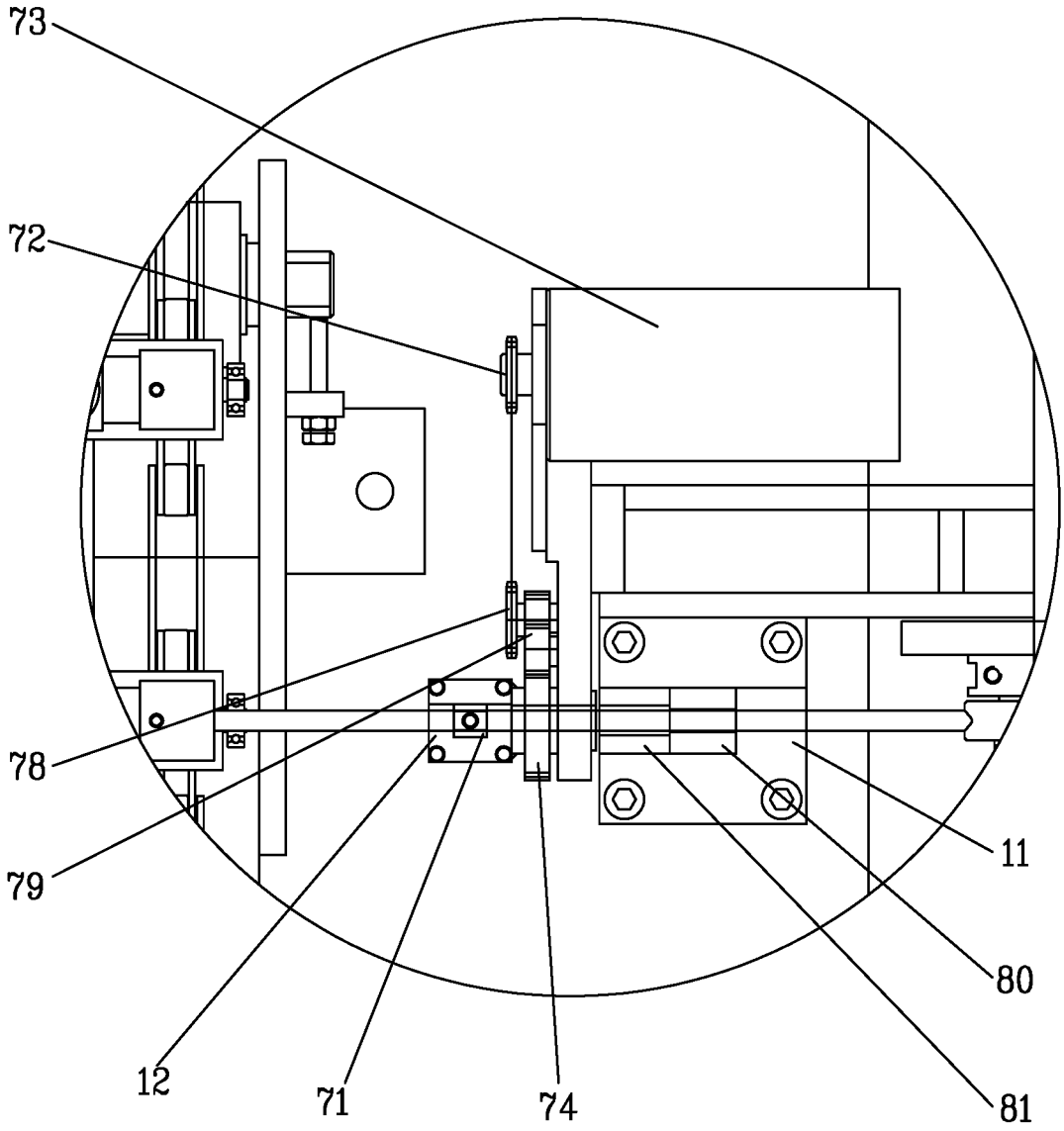

In exemplary versions according to FIGS. 6A-6B, the exemplary rotational unit 12 has a gripper with restraining tools 71 that have opening on the side so that the wire may be removed in the direction of the plane of the wires at the longitudinals storage 19. The tools 71 are activated by a cylinder so as to firmly hold the wire 2. The gripper is seated on bearing 76 and plate 75, which bearing 76 has opening in its side in the direction of the plane of the longitudinals at the longitudinals storage 19. The gripper is rotated via the motor 73 that drives the gear 74 via gear 79 and the sprocket wheels 72 and 78.

The supply of longitudinals 2 through straightener with rollers 9 permits high speeds of feeding, but is accompanied by poor quality of straightening. With given adjustments of the roller straightener 9, the straightened wire 2 exhibits a curvature in one plane, understandable in the aggregate view of FIG. 3A. As can be understood, if the wire 2 is cut and subsequently displaced by rolling or moving, the direction of its curvature is undefined. Then, when these longitudinals 2 are welded with the deposited transverse wires 6, the random locations of the curvature of the longitudinals 2 cause deformation of the mesh 3. For this reason, previously, in prior mesh welding machines, straightening with rotors was utilized.

Considering FIGS. 1, 4A-4B, the exemplary operation of feeding the longitudinals 2 is as follows. The longitudinals storage 19 is rotated so that one longitudinals location 13 is located on the longitudinals feeding line 1. The rotational unit 12 is in the feeding line 1, its gripper not impeding the advancement of the wire. The longitudinal wire 2 is pulled from the spool 7, and advanced by the advancement mechanism 8 with rollers, through the straightener with rollers 9 and also the cutter 11, and towards a sheath 18 of the longitudinals storage 19. With the advancement of the desired length of wire, the gripper of rotational unit 12 is activated, and the wire is cut in the cutter 11. Then, the cut longitudinal wire 2 is rotated relative to its axis, by the rotational mechanism 12, to a desired angle. The gripper 14 on the longitudinals storage 19 is activated, and the gripper of the rotational mechanism 12 is deactivated. The rotational mechanism 12 is rotated to its starting position, and the longitudinals storage 19 is shifted, for the production of a subsequent longitudinal member 2, a suitable number of steps that corresponds to the geometry of the under-production mesh 3.

Thus, longitudinals storage 19 transfers one empty sheath 18 to the axis 1 of wire advancement. As depicted in detail in FIGS. 4A, 4B, 5, the advancement rollers of feeding mechanism 8 are driven by motor 51 and transmissions 50 and advance the spool's wire 10 that is pulled from decoiler reel 40. With the completion of the length of advancement, the gripper of torsional unit 12 is first activated. Subsequently, cutting of the wire 2 is executed by activation of cutter 11. Then, the rotational unit 12 rotates the longitudinal wire 2 to a preselected angle, and the gripper 14 of the sheath 18 of the longitudinals storage 19 is then activated, and the gripper of the rotational unit 12 is deactivated. The longitudinals storage 19 is then shifted at the step required for the advancement of the next longitudinal. With the respective repetition of this above-described procedure, all the sheaths 18 are respectively filled with the respective longitudinals 2 that correspond to the for-production mesh 3.

With the completion of the filling of the sheaths 18 with longitudinals of the for-production mesh, the longitudinals 2 are located in their sheaths 18 and restrained by the respective grippers 14. The chain 32 with the sheaths is rotated by the motor 30 via the transmissions 31, and all the longitudinals are shifted so that their respective axes coincide with the respective corresponding respective axes of the longitudinals carrier 15. Thus, with the completion of production of the required number of longitudinal wires 2 at the longitudinals storage 19, the longitudinals storage 19 moves the sheaths 18 with the longitudinals 2 to locate the longitudinals at the receiving axes of the longitudinals carrier 15. With reference to FIGS. 1, 4A, and 4C, the longitudinals carrier 15 is moved towards the longitudinals storage 19 so that the longitudinals 2 enter into the guides 16. Then grippers 17 of the longitudinals carrier 15 are activated, and grippers 14 of the longitudinals storage 19 are deactivated. The longitudinals for welding are transported by the longitudinals carrier 15 towards the welding unit 27.

Thus, the longitudinals carrier 15 with the grippers 17 moves towards the longitudinals storage 19. Accordingly, the respective ends of the longitudinal wires enter into the respective grippers 17 and the respective guides 16 on the longitudinals carrier 15. Then, the grippers of the longitudinals carrier 17 are activated, the grippers of the longitudinals storage 14 are deactivated, and the longitudinal wires 2 are transferred from the longitudinals carrier 15 towards the welding unit 27.

With reference to FIGS. 1, 4A, and 4C, at the welding unit 27, the first transverse member 6 is deposited and welded with the longitudinals 2, and with continuing advancements and depositions of transverse members 6, the mesh 3 is produced. The advancement of the produced mesh 3 after the welding 27 may be made by a separate pulling mechanism 41 for the produced mesh 3.

Considering FIG. 4C in greater detail, the transverse wire 22 is pulled from the spool 21 that is on reel 20; is advanced by the advancement unit 23 through straightening mechanism 24 and through cutter 25; and, is then guided towards the axis 4 to the mechanisms for depositing the transverse wire 6 at the welding line 5 of the welding unit 27.

With continuing advancements of longitudinal wires 2 while producing mesh 3, and depositions of transverse wires 6 and weldings, there is produced the desired mesh 3. The longitudinal wires 2 are welded with the deposited transverse wires 6 at the welding unit 27 having the welding heads 26. The transverse wires 6 are supplied from spool 21 and reel 20 with feeding mechanisms 23, or from a feeder of precut wires and corresponding transport and deposition mechanisms. The produced mesh 3 is pulled by the mesh carrier 41, which has disposed grippers 42 for restraining and transporting the mesh. The longitudinal wires 2 are transported towards the welding heads 26 with the longitudinals carrier 15 that has the longitudinals grippers 17.

As depicted in FIG. 1, during the duration of mesh 3 production in the welding machine, the longitudinals 2 of the next mesh 3 may be produced and stored in the longitudinals storage 19. Thus, during the duration of production of mesh 3, the longitudinals of the next mesh are produced and stored in the longitudinals storage 19.

According to exemplary versions of processes within the scope of the present disclosure, the longitudinal wires 2 are fed initially to the longitudinals storage 19, then given to the longitudinals carrier 15. The longitudinals carrier 19 transports them to the welding unit 27, where they are welded with the deposited transverse wires 6. As the longitudinal wires 2 are removed from the longitudinals storage 19, supply of the longitudinals of the next mesh starts.

Figure 3B:
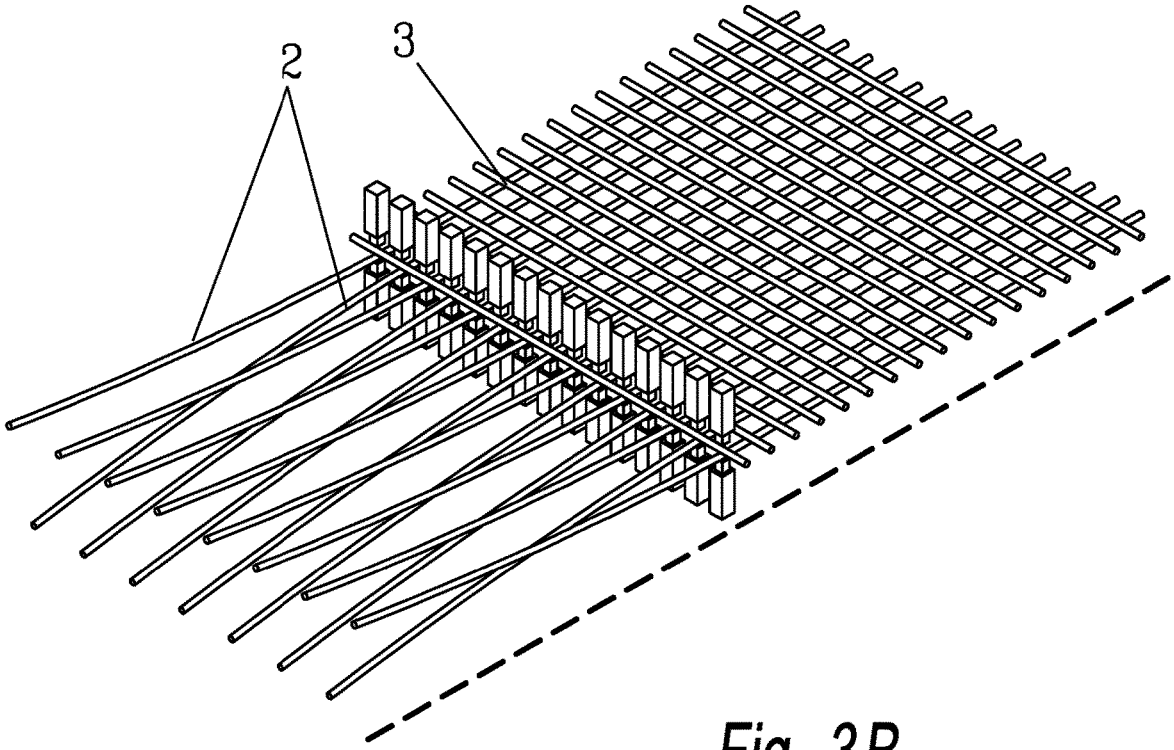
FIG. 3B—depicts the longitudinals with curvature in welded mesh, with longitudinals selectively rotated to specified angles.

According to the present disclosure, exemplary versions may apply advancement rollers 8 and a straightener 9 with rollers, in combination with a rotational unit 12; as well as longitudinals grippers 14, and grippers 17 on the longitudinals carrier 15. Each longitudinal wire 2 is produced, is restrained 12 prior to cutting, and, subsequently, being restrained by the rotational unit 12, is rotated to the suitable angle. Each longitudinal wire 2 is then restrained by the respective gripper 14 of the longitudinals storage 19, and is freed by the gripper 71 of the rotational mechanism 12. After the filling of the longitudinals storage 19, the longitudinal wires 2 are passed to grippers 17 of the longitudinals carrier 15 and transported towards the welding unit 27. The grippers 17 of the longitudinals carrier 15 restrain the longitudinals 2, at least until the welding with the first transverse wire 6. Thus, with the present exemplary processes, the curvatures of the longitudinal wires 2 may have specified directions, for example at 180°, as depicted in FIG. 3B, so that they negate one another. The produced mesh 3, in this manner, is planar.

Within the scope of the present disclosure, restraining of the longitudinals may be made via the application of active grippers, that is, grippers that exert forces using pressurized air or hydraulic fluid at high pressure. However, the grippers may be passive, that is, acting with a constant pressure upon the longitudinals, coming from a spring or air accumulator and an air cylinder. A gripper may also be a tube of length sufficient to hold in place the longitudinal wire with friction, achieving self-restraining. In each case, the longitudinal wires 2 are restrained in their respective locations, without being able to move or rotate unless they are forced to move or to rotate by the action of forces and the use of mechanisms.

Importantly, according to the present disclosure, the longitudinal wires 2 are selectively rotated to a specified angle and are restrained, from their production, until their welding in the welding unit 27. The rotation of longitudinal wires 2 may be made immediately after cutting, as depicted in the appended drawings; however, this should be understood as exemplary and non-limiting, because the rotation of longitudinal wires 2 may also be made at any intermediate location from longitudinals production until welding, for example such as at the longitudinals storage 19, or at the longitudinals carrier 15, or at the welding unit 27—before the welding of the first transverse wire 6. Thus, more generally, the key principles according to the present disclosure should be understood as (a) selectively rotating the longitudinal wires to specified angles; and, (b) as restraining them from their production until their welding in the mesh 3.

Considering these key principles, the scope of the present disclosure also comprehends that according to exemplary versions of systems and processes within the scope of the present disclosure, each longitudinal wire 2 may be rotated to a specified angle, as schematically depicted in FIG. 3B. However, each second or each third wire, or some of the longitudinal wires, may be rotated to a specified angle, provided that deformation of the produced mesh is negated entirely or satisfactorily within acceptable tolerances.

The scope of the present disclosure furthermore comprehends that according to exemplary versions of systems and processes within the scope of the present disclosure, the same procedure may be applied also to the transverse wires 6, which may be rotated around their respective axes to selected angles, one after the other, so that the curvature of the wires 6 resulting from the transverse-wire straightener 24 with rollers is effectively negated in the produced mesh 3.

The scope of the present disclosure also comprehends that according to exemplary versions of systems and processes within the scope of the present disclosure, the production of a mesh 3 having equal number of longitudinal and transverse wires, and also having same length longitudinal and transverse wires, requires the same total length of transverse wire and longitudinal wire. Thus, advancing the longitudinals and the transverse wires with the same speed or machine does not invoke delay in the production of the longitudinal wires during the duration of welding of the mesh. If there is required greater advancement speed of longitudinals, there may be placed two feeding units for longitudinals.

The scope of the present disclosure also comprehends that according to exemplary versions of systems within the scope of the present disclosure, to increase the longitudinals' feeding speed, there may be simultaneously fed more than one longitudinal wire 3 at respective locations 13. Similarly, according to exemplary versions of processes within the scope of the present disclosure, more than one longitudinal wire 2 may be supplied to longitudinals storage 19 at corresponding locations, so that productivity be increased.

The scope of the present disclosure also comprehends that according to exemplary versions of systems within the scope of the present disclosure, there may be more feeding lines with the advancement units 8 and straightening units 9, and the straightened wires converge inside guides toward the cutter 11 and the storage 19 locations 13, so that the straightened wires 2 are not permanently deformed, and so that every time there is selected the wire that shall be advanced. Similarly, according to exemplary versions of processes within the scope of the present disclosure, there may exist more than one feeding lines with the advancement units 8 and straightening units 9, and the straightened wires 2 may converge in guides towards the cutter 11 and the longitudinals storage 19 positions, so as to not be permanently deformed, and so that there may be selected, each time, the wire to be advanced.

The scope of the present disclosure also comprehends that according to exemplary versions of systems within the scope of the present disclosure, there may be two feeding lines 1, with one being in waiting, so that when one reel 40 ends, the other starts automatically without any delay in production. During the duration of production, the empty reel 40 is loaded with a new spool 7 of wire. Similarly, according to exemplary versions of processes within the scope of the present disclosure, the supply of longitudinals may be made by two feeding lines, with one being in standby, so that when a first reel ends, the other in standby then starts automatically without any production delay. During the duration of production, the empty reel is loaded with a new spool of wire.

The scope of the present disclosure also comprehends that according to exemplary versions of systems within the scope of the present disclosure, the transverse wires 6 may come from a reel 20, with advancement 23, straightening 24 and cutting 25, or may be straightened and precut and supplied from a feeder. Straightening may be made by rotors or by rollers. Similarly, according to exemplary versions of processes within the scope of the present disclosure, the transverse wire supply 22 may come from a reel 20, with advancement 23, straightening 24, and cutting 25; or may be straightened and precut and be fed by a feeder. Straightening may be made by rotors, or with rollers.

The scope of the present disclosure also comprehends that according to exemplary versions of systems and processes within the scope of the present disclosure, the longitudinals 2 may be straightened at a straightener with rollers 9 and be fed from separate feeding rollers 8, or may be straightened at a straightener that has powered straightening rollers.

The scope of the present disclosure also comprehends that according to exemplary versions of systems and processes within the scope of the present disclosure, each mesh 3 may be different in dimension without any effect on productivity. By a programming of the produced longitudinal wires 2 into the appropriate positions (receivers) 13 of the longitudinals carrier 19, the change of mesh 3 does not involve any delay in the machine.

The scope of the present disclosure also comprehends that according to exemplary versions of systems and processes within the scope of the present disclosure, the positions 13 of the longitudinals storage 19 may be mounted on chain 32, as in the explanatory, exemplary FIGS. 4-5. However, in an alternative arrangement, the positions 13 of the longitudinals storage 19 may be moved on a carrier perpendicular to the feeding direction for the longitudinals, as, for example, exemplified in drawing 2 of commonly-owned previous published application WO2011/010256A1.

The present disclosure should also be understood to also set forth exemplary processes for feeding longitudinal wires or rods 2 to a mesh production machine, according to which the mesh 3 is produced from the welding of longitudinal wires 2 with transverse wires 6 at a welding unit 27. The longitudinal wires 2 are pulled from reel 40, straightened, deposited at a longitudinals storage 19, and then received by a longitudinals carrier 15 and moved towards the welding unit 27. The respective longitudinal wires 2 are selectively rotated at a selected angle around their respective longitudinal axis by a suitable mechanism, and restrained 14, 17 until their welding with transverse wires 6, so as to negate in the totality of wires any possible curvature they may have acquired during their straightening with rollers 9, so that after their welding, mesh 3 is produced planar with its distortion stresses neutralized.

Optionally, in versions of exemplary processes according to the immediately preceding paragraph above, only some of the longitudinal wires may be rotated to desired angles around their respective longitudinal axes so that their curvature resulting from the straightener with rollers is negated.

Optionally, in versions of exemplary processes according to this same preceding paragraph above, the rotation of the longitudinal wires 2 around their respective longitudinal axes may be made at any location in their path from their production location to the welding location 27.

Optionally, in versions of exemplary processes according to this same preceding paragraph above, the longitudinal wires 2 are actively restrained with grippers 71, 14, 17 during the entire duration of their transport from the production location, from cutting 11 until the rotation 12 and again until the location of welding 27 with the transverse wires 6.

Optionally, in versions of exemplary processes according to this same preceding paragraph above, the longitudinal wires 2 are passively held with frictional restraint in the intermediate mechanism during the entire duration of their transport from the production location, cutting 11 until the rotation 12, and again until the location of welding 27 with the transverse wires 6.

Optionally, in versions of exemplary processes according to this same preceding paragraph above, there may be parallel supplies of longitudinal wires 2 coming from additional reels 40, pulling mechanisms 8, straighteners 9, cutters 11; these parallel supplies guide longitudinal wires 2 simultaneously into additional sheaths 18 of the storage 19.

Optionally, in versions of exemplary processes according to this same preceding paragraph above, the longitudinal wires 2 may come from more than one reel 40, being straightened 9 and advanced 8 by respective units, the wires 2 converging towards the feeding line 1 of the wire storage 19, and there being made automated selection of the wire that shall fill the location 13 for longitudinal wire 2 to be subjected to filling.

Optionally, in versions of exemplary processes according to this same preceding paragraph above, the transverse wires 6 of the mesh 6 are produced from a spool 21 on reel 20, with advancement 23, straightening 24, cutting 25 of the wire 22, deposition and welding at the welding unit 27.

Optionally, in versions of exemplary processes according to this same preceding paragraph above, the transverse wires 6 with which the mesh 3 is produced come from straightened and precut wires that are deposited and welded with the longitudinal wires 2 at the welding unit 27.

Optionally, in versions of exemplary processes according to this same preceding paragraph above, the transverse wires 6 with which the mesh is produced, may be rotated around their respective axes to desired angle so that any curvature coming from the straightener with rollers be effectively negated.

The present disclosure should also be understood to also set forth exemplary systems for feeding longitudinal wires or rods 2 to a mesh production machine, according to which mesh 3 is produced from the welding of longitudinal wires 2 with transverse wires 6 at a welding unit 27, which longitudinal wires are pulled 8 from reel 40, straightened 9, deposited at a longitudinals storage 19, in following being received by a longitudinals carrier 15 and transported towards the welding unit 27. The transverse wires 6 are fed towards the welding unit 27, with the mesh 3 being produced by continuing advancements of longitudinals 2, depositions of transverse wires 6, and weldings. The longitudinal wires 2 are straightened in a straightener with rollers 9, are advanced by advancement rollers 8 through cutter 11 and rotational unit 12, towards the sheaths 18 of the longitudinals storage 19, which storage has sheaths 18 and grippers 14 for each deposited longitudinal wire 2. With the completion of advancement for each longitudinal wire 2 there is activated the gripper 71 of the rotational unit 12. The cutter 11 then cuts the wire 2, the rotational unit 12 rotates the cut longitudinal wire 2 around its longitudinal axis at the desired angle. The respective gripper 14 of respective sheath 18 of the longitudinals storage 19 is activated. The longitudinals storage 19 rotates at the step of the longitudinals of the mesh 3. The next longitudinal 2 is produced and, with continuing advancements of longitudinals, there is produced the totality of longitudinals of the to-be-produced mesh. In following, the longitudinals are received by the longitudinals carrier 15 that has grippers 17, and during this receiving, the longitudinals grippers 17 of the longitudinals carrier 15 are activated, while afterwards the grippers 14 are deactivated on the longitudinals storage 19. The longitudinals carrier 15 transports the longitudinal wires 2 to the welding unit 27, where they are welded with the first deposited transverse wire 6, and, in following, the mesh 3 is received by the mesh carrier 41. The longitudinals carrier 15 returns towards the longitudinals storage 19 for a new receiving of longitudinals 2 while mesh production continues.

Optionally, in exemplary systems according to the immediately preceding paragraph above, the longitudinals storage 19 has sheaths 18 in tubular form that are seated on chains 32, with the distance between the sheaths 18 corresponding to the least distance of the longitudinal wires 2 of the mesh 3. There is a respective gripper 14 at the beginning of each respective sheath 18, and the chains 32 are movable on sprocket wheels that are driven by motor 30 through the transmissions 31.

Optionally, in exemplary systems according to this same preceding paragraph above, the rotational unit 12 located after the cutter 11 has gripper 71 that can rotate around the axis of the held wire, and thus also rotates the held wire to desired angle.

Optionally, in exemplary systems according to this same preceding paragraph above, the longitudinal wires 2 are restrained by grippers 14 in the longitudinals storage 19. Then, subsequently, they are restrained by grippers 17 at the longitudinals carrier 15, so as not to rotate during their transport due to internal stresses and curvature of the wires.

Generally regarding the scope of protection of the appended claims, it should be understood in the context of the preceding discussion that the present invention is not limited in any manner to the described and drawings-depicted implementations, but may be realized in many forms and dimensions without abandoning the region of protection of the invention. For example, in implementations of the invention the materials that are employed and also as well the dimensions of particular elements may be according to the demands of a particular construction. Thus, in closing, it should be noted that the invention is not limited to the abovementioned versions and exemplary working examples. Further developments, modifications and combinations are also within the scope of the patent claims and are placed in the possession of the person skilled in the art from the above disclosure. Accordingly, the processes and systems described and illustrated herein should be understood to be illustrative and exemplary, and not necessarily limiting upon the scope of the present invention. Furthermore, in every claim, wherein recitation is followed by reference numbers or labels, these are included solely to increase the understandability of the claims, and in this manner the reference numerals do not affect the consideration of the recited elements and characteristics, which are exemplarily recognizable with them. The scope of the present invention is defined by the appended claims, including known equivalents and unforeseeable equivalents at the time of filing of this application.

REFERENCE LABELS LIST

1—axis of wire advancement
2—longitudinal wires (rods, members)
3—mesh
4—axis of transverse wire advancement
5—axis of welding line
6—transverse wires (rods, members)
7—spool
8—advancement rollers (pulling/feeding mechanism)
9—straightener with rollers
10—wire (for longitudinal wire production)
11—cutter
12—rotational unit
13—positions/locations(receivers) of longitudinal wires on longitudinals storage
14—gripper
15—longitudinals carrier
16—guides on longitudinals carrier
17—grippers of carrier
18—sheath
19—longitudinals storage
20—reel
21—spool
22—wire (for transverse wire production)
23—advancement mechanism
24—straightener
25—cutter
26—welding head
27—welding unit
30—motor
31—transmissions
32—chains
40—reel (decoiler)
41—mesh carrier
42—mesh grippers
50—transmissions
51—motor
71—gripper tools of rotational unit (12)
72—sprocket wheel
73—motor for rotational unit
74—gear
75—plate
76—bearing
78—sprocket
80—movable tool of cutter (11)
81—fixed cutting tool of cutter (11)

What is claimed is:

1. A system for feeding wire to a mesh production machine, comprising:

a straightener for wire performing a partial straightening;

a cutter arranged to receive wire from said straightener;

a longitudals storage configured to receive longitudinal wires cut by said cutter, said longitudinals storage having a plurality of longitudinals receivers;

a rotational unit, said rotational unit having a rotation gripper, said rotational unit being configured to controllably rotate one or more cut longitudinal wires around their longitudinal axes to specified angles via said rotation gripper;

said rotational unit is configured to selectively rotate selected ones of said one or more cut longitudinal wires around their longitudinal axes to said specified angles so as to negate their curvature when welded to form a planar mesh;

a plurality of storage grippers each configured to restrain a respective one of the longitudinal wires at respective longitudinals receivers in said longitudinals storage;

a welding unit, and a longitudinals carrier configured to transfer longitudinals wires from said longitudinals storage towards said welding unit, said longitudinals carrier having carrier grippers configured to restrain the longitudinal wires against free rotation around their respective longitudinal axes at least until each said longitudinal wire is welded with a respective transverse wire; and said rotational unit occupying at least one intermediate location along a longitudinal wire transport path that extends between said cutter and said welding unit.

2. The system for feeding wire to a mesh production machine as claimed in claim 1, wherein:

said plurality of storage grippers are configured to restrain longitudinal wires against free rotation around their longitudinal axes.

3. The system for feeding wire to a mesh production machine as claimed in claim 1, further comprising:

a motor operatively connected to controllably drive said rotational unit to controllably rotate cut longitudinal wires around their longitudinal axes to specified angles via said rotation gripper.

4. The system for feeding wire to a mesh production machine as claimed in claim 1, further comprising:

each of said storage grippers being located at a respective wire receptacle, each respective wire receptacle being associated with a respective longitudinals receiver of said longitudinals storage; and, said rotational unit being disposed between said cutter and said longitudinals storage.

5. The system for feeding wire to a mesh production machine as claimed in claim 1, wherein:

said rotation gripper of said rotational unit is mounted to rotate held longitudinal wires around their respective axes to desired angles.

6. The system for feeding wire to a mesh production machine as claimed in claim 1, further comprising:

chains included in said longitudinals storage, said chains being operatively connected to position said longitudinals receivers and said storage grippers;

sprocket wheels upon which said chains rotate; and, a motor, said motor being operatively connected to at least one transmission driving said chains to position any of said plurality of longitudinals receivers to receive longitudinal wires.

7. The system for feeding wire to a mesh production machine as claimed in claim 1, wherein said rotation gripper comprises:

one or more restraining tools;

said restraining tools have a side opening configured to permit wire removal in a direction of a plane of longitudinals receivers at said longitudinals storage;

a motor operatively connected to activate said restraining tools to hold wire; and a bearing supporting said rotation gripper, said bearing having an opening in its side in the direction of the plane of longitudinals receivers at said longitudinals storage.

8. A system for feeding wire to a mesh production machine, comprising:

longitudinals storage configured to receive cut longitudinal wires, said longitudinals storage having a plurality of longitudinals receivers;

a rotational unit, said rotational unit having a rotation gripper, said rotational unit being configured to controllably rotate one or more cut longitudinal wires around their respective longitudinal axes to specified angles via said rotation gripper;

said rotational unit is configured to selectively rotate selected ones of said one or more cut longitudinal wires around their longitudinal axes to said specified angles so as to negate their curvature when welded to form a planar mesh;

a plurality of storage grippers each configured to restrain each respective ones of said longitudinal wires at respective longitudinals receivers in said longitudinals storage;

a welding unit, and a longitudinals carrier configured to transfer each respective longitudinal wire from said longitudinals storage towards said welding unit, said longitudinals carrier having a plurality of carrier grippers configured to restrain respective said longitudinal wires during said transfer against free rotation around their respective longitudinal axes at least until each said longitudinal wire is welded with a respective transverse wire; and said rotational unit occupying at least one inteimediate location along a longitudinal wire transport path towards said welding unit.

9. The system for feeding wire to a mesh production machine as claimed in claim 8, wherein:

said storage grippers are configured to restrain longitudinal wires against free rotation around their longitudinal axes.

10. The system for feeding wire to a mesh production machine as claimed in claim 8, further comprising:

a motor operatively connected to controllably drive said rotational unit to controllably rotate cut longitudinal wires around their longitudinal axes to specified angles via said rotation gripper.

11. The system for feeding wire to a mesh production machine as claimed in claim 8, further comprising:

each of said storage grippers being located at a respective wire receptacle, and each respective wire receptacle being associated with a respective longitudinals receiver of said longitudinals storage.

12. The system for feeding wire to a mesh production machine as claimed in claim 8, wherein:

said rotation gripper of said rotational unit is mounted to rotate held longitudinal wires around their respective axes to desired angles.

13. The system for feeding wire to a mesh production machine as claimed in claim 8, further comprising:

chains included in said longitudinals storage, said chains being operatively connected to position said longitudinals receivers and said storage grippers;

sprocket wheels upon which said chains rotate; and a motor, said motor being operatively connected to at least one transmission driving said chains to position any of said plurality of longitudinals receivers to receive longitudinal wires.

14. A process for mesh production, comprising the steps of:

pulling a spooled wire from a spool and forming a pulled wire;

partially straightening the pulled wire;

restraining by gripping the pulled wire;

cutting the restrained straightened pulled wire to produce at least one longitudinal wire;

selectively rotating each said respective longitudinal wire around their respective longitudinal axes to specified angles;

depositing each said respective longitudinal wire at a longitudinals storage;

transferring each said respective longitudinal wire from the longitudinals storage to a longitudinals carrier;

moving each said respective longitudinal wire via the longitudinals carrier towards a welding unit;

welding each said longitudinal wire into a mesh with a transverse wire; and, restraining each said respective longitudinal wire from their production at said step of cutting at least until their respective said step of welding with a first transverse wire in the mesh;

wherein said step of selectively rotating grip-restrained respective longitudinal wires around their respective longitudinal axes to specified angles further comprises the step of rotating only selected ones of the longitudinal wires to desired angles around their respective longitudinal axes so as to negate their curvature when welded to form a planar mesh.

15. The process as claimed in claim 14, wherein:

said step of selectively rotating grip-restrained respective longitudinal wires around their respective longitudinal axes to specified angles includes rotating grip-restrained respective longitudinal wires around their respective longitudinal axes at at least one intermediate location in their path from their production to their welding.

16. The process as claimed in claim 14, wherein:

said step of restraining the longitudinal wires from their production at cutting at least until their welding includes actively restraining the longitudinal wires with grippers from their production at cutting until their welding.

17. A process for mesh production, comprising the steps of:

restraining cut longitudinal wire by gripping the cut longitudinal wire;

selectively rotating grip-restrained respective longitudinal wires around their respective longitudinal axes to specified angles;

depositing the longitudinal wires at a longitudinals storage;

transferring the longitudinal wires from the longitudinals storage to a longitudinals carrier;

moving the longitudinals wires via the longitudinals carrier towards a welding unit;

welding the wires into mesh with transverse wire; and restraining the longitudinal wires at least until their welding with a first transverse wire in the mesh, wherein:

wherein said step of selectively rotating grip-restrained respective longitudinal wires around their respective longitudinal axes to specified angles, further comprises a step of rotating only selected ones of the longitudinal wires to desired angles around their respective longitudinal axes so as to negate one another's respective curvature when welded to form a planar mesh.

18. The process as claimed in claim 17, wherein:

said step of selectively rotating grip-restrained respective longitudinal wires around their respective longitudinal axes to specified angles includes rotating grip-restrained respective longitudinal wires around their respective longitudinal axes at at least one intermediate location in their path to their welding.

* * * * *